US005921546A

United States Patent [19]

Herman

[11] Patent Number: 5,921,546

[45] Date of Patent: Jul. 13, 1999

[54] APPARATUS FOR DECELERATING SHEET MATERIAL WHILE MAINTAINING SHEET REGISTRATION

[75] Inventor: John Laurence Herman, Huber Heights, Ohio

[73] Assignees: Heidelberg Finishing Systems, Dayton, Ohio; Heidelberg Druckmaschinen, Heidelberg, Germany

[21] Appl. No.: 08/867,078

[22] Filed: Jun. 2, 1997

Related U.S. Application Data

[51] Int. Cl.[6] ..... B65H 5/34; B65H 5/02

[52] U.S. Cl. ..... 271/270; 271/276; 271/277; 271/183; 271/82

[58] Field of Search ..... 271/10.09, 10.11, 271/94, 95, 120, 225, 276, 277, 902, 270, 182, 183, 82

[56] References Cited

U.S. PATENT DOCUMENTS

| | | | |
|---|---|---|---|
| 2,830,813 | 4/1958 | Hepp | 271/95 |
| 3,552,740 | 1/1971 | Hepp | 271/95 X |
| 3,602,495 | 8/1971 | Hepp | 271/95 X |
| 4,180,255 | 12/1979 | Himmel . | |
| 5,100,118 | 3/1992 | Hobbs et al. . | |
| 5,174,559 | 12/1992 | Diamantides . | |
| 5,265,858 | 11/1993 | Hobbs et al. . | |
| 5,447,302 | 9/1995 | Curley . | |
| 5,455,604 | 10/1995 | Adams et al. | 271/277 X |

FOREIGN PATENT DOCUMENTS

| | | | |
|---|---|---|---|
| 0654431 | 5/1995 | European Pat. Off. . | |
| 1341929 | 9/1963 | France | 271/95 |
| 775833 | 5/1957 | United Kingdom | 271/95 |
| 1012970 | 12/1965 | United Kingdom | 271/95 |
| 2171083 | 8/1986 | United Kingdom | 271/277 |

*Primary Examiner*—Boris Milef
*Attorney, Agent, or Firm*—Tarolli, Sundheim, Covell, Tummino & Szabo

[57] ABSTRACT

The present invention relates to a sheet handling apparatus having a hopper drum (1) for receiving individual signatures (23) from a feed tray, the hopper drum being equipped with at least one set of signature seizing grippers (16). A hopper drum surface element (13) revolves counter to a direction of rotation (7) of the hopper drum (1) upon reversal of direction (33) of the signatures (23). A seizing element (26) is assigned to the direction reversal position (38) of the signatures (23).

12 Claims, 1 Drawing Sheet

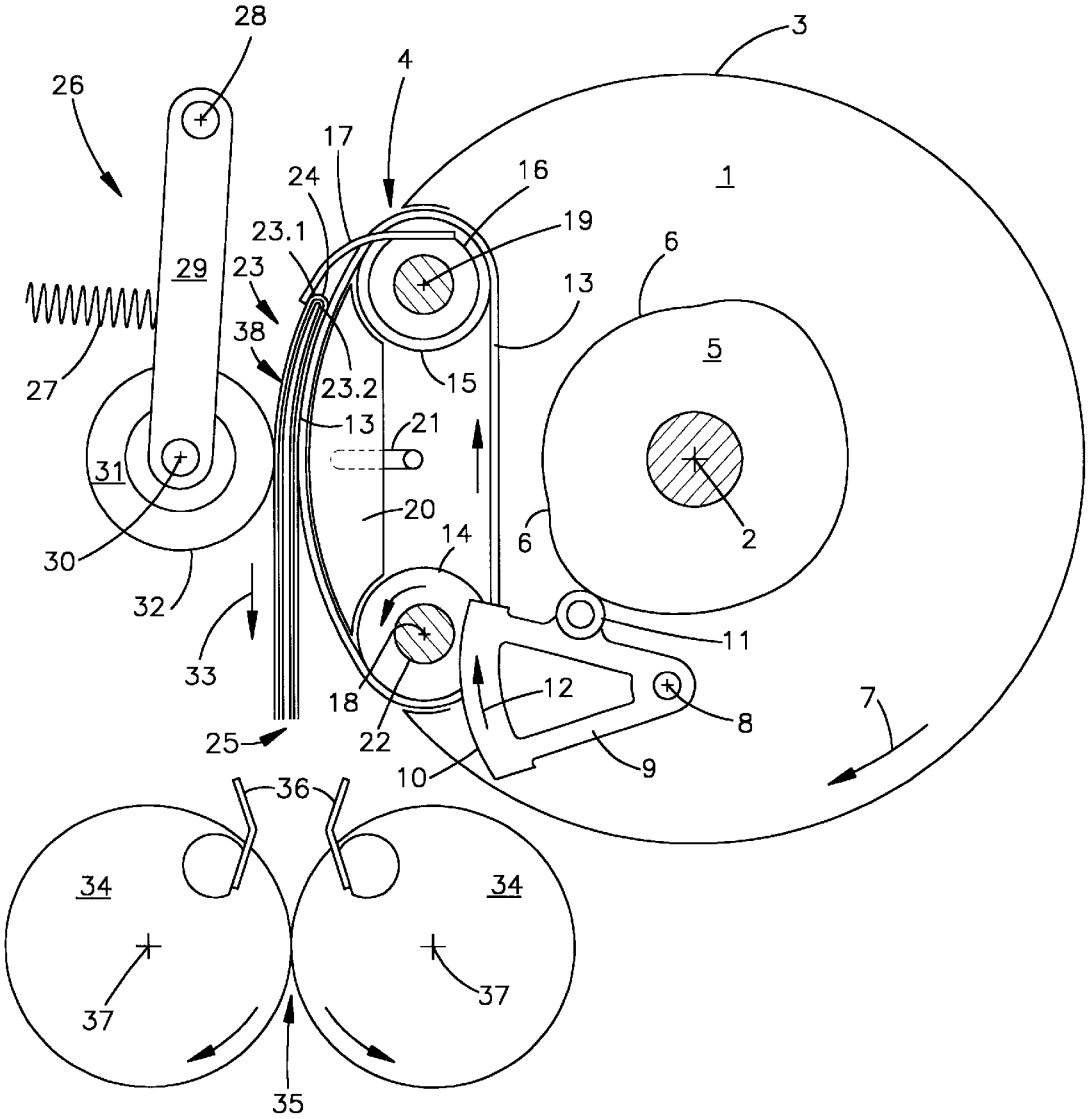
28
26
4
3
17
24
16
1
23.1
19
29
23
6
13
38
5
27
23.2
15
13
21
31
20
2
30
14
6
32
11
33
18
12
8
7
25
22
9
10
36
34
34
37
37
35

APPARATUS FOR DECELERATING SHEET MATERIAL WHILE MAINTAINING SHEET REGISTRATION

FIELD OF THE INVENTION

The present invention relates to an apparatus for decelerating sheet material while maintaining sheet registration in a publication collating machine and for feeding individual signatures or groups of pages to a collating conveyor.

BACKGROUND OF THE INVENTION

U.S. Pat. No. 4,180,225 discloses a signature inserter for a saddle gathering machine including a rotatable extractor drum for extracting a signature from a hopper and carrying it to a stop position on the periphery of the drum. A reciprocating dipper contacts the lower cut edge of the signature and moves the cut edge into a gripping position beside a transfer drum. A wiper vane rotatably mounted in the path adjacent the extractor and transfer drums wipes the lower edge of the signature onto the dipper then rotates away from the signature. Grippers associated with the transfer drum grip the lower edge of the signature and carry it away from the extractor drum toward an opener drum. The transfer drum and the opener drum cooperate to open the signature and deposit it on a saddle.

U.S. Pat. No. 5,447,302 relates to a differential gripper system. An apparatus for removing paper products from a stack on a hopper comprises a rotatably mounted gripper drum which rotates about a central axis at a substantially constant angular velocity. A stationary cam is rigidly mounted adjacent the gripper drum. A gripper mechanism is mounted on the gripper drum and rotates with the drum. The gripper mechanism is provided for gripping a paper product, removing it from a stack and slaving it along the direction of rotation of the gripper drum. A linkage mechanism, which is also mounted on the gripper drum and which rotates with the drum, is provided for angularly displacing the gripper mechanism relative to the gripper drum, i.e., to accelerate and decelerate the gripper and to operatively link the gripper mechanism with the cam.

U.S. Pat. No. 5,174,559 discloses a sheet material handling apparatus and method using a skewed sheet stack and an alignment mechanism. An apparatus for handling sheet material articles includes a hopper which supports a stack of sheet material articles with front-edge portions of the articles being skewed at an acute angle to the axis of rotation of a feed drum. A separator is sequentially engageable with a corner portion of the sheet material articles to move the corner portion of an article away from a next succeeding sheet material article. The feed drum pulls a sheet material article from the hopper with the front edge portion of the sheet material article skewed at an acute angle to the axis of rotation of the feed drum. While a portion of the sheet material article is still in the hopper, the sheet material article moves from between the separator and the next sheet material article to the separator. A conveyor receives the sheet material article from the feed drum. A plurality of alignment rods engage a leading end portion of the sheet material article as it moves toward the conveyor and rotates the sheet material article into alignment with the conveyor.

U.S. Pat. No. 5,100,118 discloses a pair of saddle conveyors. An extractor drum sequentially grips folded edge portions of signatures in hoppers and moves the signatures along an arcuate path. During rotation of the extractor drum, a first signature engages a first stop member and is transferred to a first saddle conveyor. The first stop member is then retracted and the next signature moves past the first stop member into engagement with a second stop member. The second signature is then transferred to a second saddle conveyor. A single stitcher assembly is provided to stitch signatures in first and second spaced apart streams of signatures being conveyed by the two saddle conveyors. In addition, a single trimmer assembly is provided to trim the signatures while maintaining the signatures in the first and second spaced apart streams of signatures.

U.S. Pat. No. 5,265,858 and EP 0,654,431 A1 disclose an apparatus for converting a sheet material feeder from on edge to bottom feed. An existing sheet material feeder has a feed tray which holds sheet material in an on-edge orientation in which side surfaces of the sheet material are generally vertical. An apparatus is provided to convert the sheet material feeder to one having a feed tray which holds sheet material in a lying-down orientation in which side surfaces of the sheet material are generally horizontal. The apparatus for converting the on-edge sheet material feeder to the lying-down sheet material feeder includes a frame having a pair of parallel side sections. A single sheet material feed drum is disposed between and is connected with the side sections. The side sections are connected with side sections of the collator conveyor sheet material feeder.

SUMMARY OF THE INVENTION

It is an object of the present invention to improve a hopper design in that a smooth deceleration of a signature is achieved without losing custody of the signature.

Another object of the present invention is to have the velocity of the main hopper drum substantially unchanged.

A still further object of the present invention is to prevent a signature, particularly a low page-count signature, from collapsing upon impact against a registration stop.

With these objects in view, an arrangement according to the present invention comprises a hopper drum receiving individual signatures from a feed tray, said hopper drum being equipped with at least one set of signature-seizing grippers, a surface element of said hopper drum revolving opposite to a direction of rotation of said hopper drum to reverse the signature direction and a seizing element to receive said signature when reversed.

Advantageous with the present solution is a deceleration of the signatures, then a reversal of signature direction without losing custody of the signatures. Thus, upon reversal of the signature transport direction by a surface element moving opposite to the direction of rotation of the main hopper drum, the signatures' open trailing edges are in the position to be picked up by signature-opening grippers. Consequently, the velocity of the main hopper drum can remain unchanged, thus, not inducing any vibrations into the hopper system. The surface element, for example, a set of belts, is gradually accelerated upon release of the signature's backbone by a set of grippers assigned to the surface of the main hopper drum.

According to further embodiments of the instant invention, said surface elements are a group of belts. The belts may be arranged across the width of the main hopper drum so as to be spaced from one another. Furthermore, the hopper drum is equipped with a bearing element within a segment of its circumference for the supporting of the respective signatures.

The surface elements extend around supports, one of which being driven by an actuator comprising a cam follower cooperating with a stationary cam. Instead of a cam follower design, a separate electric motor drive within the main hopper drum is conceivable as well.

The set of grippers for releasing the respective signature's backbone to permit reversal of the signature's conveying direction are mounted on one of the supports for the surface element. Upon release of the signature's backbone and during the change of the signature's conveying direction, custody of the signature is fully maintained by a seizing element assigned to the signature's release position on the main hopper drum. The actuator of the surface element accelerates the surface element in a direction opposite to the direction of rotation of the main hopper drum. Thus, the velocity of the main hopper drum remains substantially unchanged. Due to the fact that a reversal of signature conveying direction is maintained, the edges of the signature which trailed the signature backbone prior to reversal of the signature direction can be picked up by grippers in order to open up the signature prior to conveyance of the signature to a saddle element.

BRIEF DESCRIPTION OF THE DRAWINGS

Although the novel features believed to be characteristic of this invention will be stated in detail in the appended claims, the manner of its operation and the mode of its operation will be understood by referring to the following description read in conjunction with the accompanying drawing, in which:

FIG. 1 shows a mechanism according to the present invention to decelerate, stop and reverse the direction of a signature without changing the velocity of a main hopper drum.

DESCRIPTION OF PREFERRED EMBODIMENT

FIG. 1 shows a main hopper drum 1 which rotates in a clockwise direction as indicated by arrow 7. The main hopper drum 1 rotates around a hopper drum axis 2. The surface 3 of the main hopper drum 1 is interrupted by a segment 4 in which a movable surface element 13 is mounted. Attached to the hopper drum axis 2 is a stationary cam 5 which cooperates with an actuating unit, including a rack and pinion drive 9, 11, 22, to drive the surface element 13 within said main hopper drum 1. The actuating unit comprises, for example, a rack 9 mounted so as to be pivotable around a pivot axis 8. The rack 9 moves in a direction indicated by arrow 12. The rack 9 has a surface segment 10 having a meshing engagement with a pinion 22 which is fixed to rotate the lower one of supports 14, 15 assigned to the movable surface element 13. The cam follower 11 can be biased by a spring (not shown) into engagement with the cam surface 6. The cam follower 11 of the rack 9 is moved such that said movable surface element 13 within the main hopper drum 1 is moved counter to the direction of rotation 7 of the main hopper drum 1 upon release of a signature 23 by a gripper 16 arranged on the upper support 15. When the signature 23, upon rotation of the drum 1, has reached a signature release position 38, the conveying direction of said signature 23 is reversed.

When the lower support 14 is rotated by the rack segment 10 and pinion 22, said lower support 14 is accelerated in a counterclockwise direction. The lower support 14 drives (moves) the surface element 13, here being a group of belts which are spaced apart from one another in a direction transverse to the direction indicated by arrow 7, in a counterclockwise direction as well. The surface element 13 moves relative to the upper support 15 which rotates with drum 1 but is otherwise stationary. Alternatively, the upper support 15 could rotate about its axis 19 relative to the drum 7, in which case the gripper 16 would be mounted on the drum adjacent the upper support 15.

The rack pinion drive shown in FIG. 1 could be replaced by a suitable gearing to perform the same function of accelerating said movable surface element 13 when a signature reaches the signature reversal position 38. An electric motor is also conceivable as an actuating unit within the hollow interior of the main hopper drum 1.

Within the segment 4 of the surface 3 of the main hopper drum 1 the surface element 13 is mounted by the upper and the lower support 14, 15, respectively. In the given embodiment a gripper 16, having a gripper finger 17, is mounted on the second support 15 which is the upper support. Between both supports 14, 15 a respective bearing element 20 is mounted. The surface of bearing element 20 supports the movable surface element 13, namely the belts to keep the belts in a shape which matches the contour of the outer surface 3 of the drum 1. Thus, the segment 4 of the main hopper drum 1 is being bridged by the movable surface element 13 which is supported by the bearing element 20 and the supports 14, 15. In order to provide low friction between the surface of bearing element 20 and the surface element 13, an air supply line 21 is provided to connect the hollow interior of the bearing element 20 to an expanding medium, such as air. The hollow interior of the bearing element 20 communicates with the outer surface of the bearing element 20 by passages not shown and thus air is directed between the surface element 13 and the bearing element 20 to reduce friction between these parts.

A signature-seizing element 26 is assigned to the main hopper drum 1. The seizing element 26 includes a rotating surface element 31 having a surface 32 which contacts the signatures 23. The rotating surface element 31 rotates around an axis of rotation 30 which is provided on a support 29, i.e., a lever mounted to pivot around an axis 28. For exerting a pretensioning force on said support 29, a pretensioning device 27, such as a helical spring or the like, maintains the contact between the rotating surface element 31 and the surface of the signature 23 which is being seized on the surface 3 of the main hopper drum 1.

In the position 38 of the main hopper drum 1, as shown in the accompanying drawing, a signature 23 has adopted a substantially vertical position, its backbone 24 (folded end) being gripped by the gripper finger 17 of the gripper 16. The signature 23 shown here comprises a first and a second signature layer 23.1 and 23.2. In the area of the gripper finger 17 of the gripper 16 registration stops may be provided to allow for correct registration of the signatures 23 on the surface 3 of the main hopper drum 1. The backbone 24 of the signature would contact such registration stops if such registration stops are used. The open edges 25 of the signatures are shown to be in a position to be picked up by grippers 36 of transfer drums 34 arranged below the main hopper drum 1 and the seizing element 26.

Upon downward movement of the signatures 23, as indicated by the arrow 33, the respective open edges 25 of the signatures 23 are picked up by the grippers 36 assigned to the drums 34 which rotate around axes 37. The signatures 23, being opened up at their respective edges 25, are conveyed to collecting saddles, from which the signatures are picked up by a collating conveyor. Note that the edges 25 of the signatures were trailing edges when the signatures are being conveyed by drum 7 in the direction of arrow 7.

According to the present invention, the signatures 23 are gripped by the grippers 16 of the main hopper drum 1. Then, the signatures 23 are supported on the surface 3 of the main hopper drum 1 and conveyed until they reach the signature direction reversal position 38. The movable surface element 13 within the main hopper drum 1 is not driven during most of this movement. The signatures 23, while rotated with the main hopper drum 1, are contacted by the seizing element 26, the seizing surfaces 32 of which being spaced axially apart from one another so as to allow for passing of the respective gripper finger 17 of said gripper 16, in order to fix the signature's backbone 24 on the surface 3 of the main hopper drum 1. Upon release of the signature's backbone 24 by the gripper finger 17, the movable surface element 13 is actuated by the actuating unit described hereinbefore. The movable surface element 13, being, for example, a group of belts or the like arranged in spaced apart relation across the width of said main hopper drum 1, decelerates the movement of the signatures 23 on the main hopper drum 1, before they arrive at fixed registration stops, if the registration stops have not been eliminated. Thus, impact of the registration stops against low page-count signature is eliminated and the tendency of the signatures 23 to collapse is reduced. Also, upon release of the signatures 23 in the position 38, the movable surface element 13 is accelerated and changes the movement of the signatures 23 into the reverse direction, as indicated by the arrow 33. After the signatures 23 have smoothly arrived at the registration stops (if the registration stops have not been eliminated) and been released by the grippers 16 on the surface 3 of the main hopper drum 1, the signatures' trailing edges 25 are fed by element 13 into the opening grippers 36 on the transfer drums 34 which rotate around the axes 37.

Complete control of the signatures 23 upon reversal of the conveying direction is maintained, owing to the seizing element 26 which cooperates with the surfaces of the signatures 23 while they are supported by the movable surface element 13 which, in turn, is supported by a yieldable air-bearing 20. Thus, no relative movement between the surface of the signatures 23, the surface of the moving surface element 13 and the rotating surface 32 of the seizing element 26 occurs. The edges 25 of the respective signatures 23, thus, remain in suitable positions to be easily picked up by the opening gripper 36 for further processing.

From the above description of the invention, those skilled in the art will perceive improvements, changes and modifications. Such improvements, changes and modifications within the skill of the art are intended to be covered by the appended claims.

Having described the invention, the following is claimed:

1. Sheet handling apparatus comprising:

a hopper drum (1) for receiving individual signatures (23), said hopper drum (1) being equipped with at least one set of signature-seizing grippers (16);

a hopper drum surface element (13) revolving counter to a direction of rotation of said hopper drum to reverse the direction (33) of said signatures when released by said grippers; and a signature seizing element (26) assigned to the reversal position (38) of said signatures, wherein said surface element (13) is a group of belts.

2. Sheet handling apparatus according to claim 1, wherein said belts are spaced apart from one another in a direction transverse to the direction of hopper drum movement.

3. Sheet handling apparatus according to claim 1, wherein within a hopper drum segment (4) a bearing element (20) for the support of the respective signatures (23) is mounted.

4. Sheet handling apparatus according to claim 3, wherein the bearing element (20) includes a supply line (21) for an expanding medium.

5. Sheet handling apparatus according to claim 1, wherein the belts (13) are supported by supports (14, 15), one of which being driven by an actuating unit (9, 11, 22).

6. Sheet handling apparatus according to claim 5, wherein the actuating unit is a rack (9) and a pinion (22) drive.

7. Sheet handling apparatus according to claim 5, wherein the actuating unit (9, 11, 22) drives one support (14) of said surface element (13).

8. Sheet handling apparatus according to claim 5, wherein said grippers (16) are mounted on a respective axis (19) of at least one of the supports (14, 15) for the surface element (13).

9. Sheet handling apparatus according to claim 5, wherein the surface element (13) of the hopper drum (1) is accelerated by the actuating unit (9, 11, 22) when the signatures (23) adopt a direction reversal position (38).

10. Sheet handling apparatus according to claim 1, wherein upon release of the signatures (23) by said at least one set of grippers (16), said signatures are seized between a yieldable element (20) and a rotating surface (32) of the seizing element (26).

11. Sheet handling apparatus according to claim 10, wherein upon reversal of direction (33) of the signatures (23) they are respectively seized without relative speed between the surfaces of the signatures (23) and the rotating surface (32) of the seizing element (26).

12. Sheet handling apparatus, comprising:

a hopper drum (1) for receiving individual signatures (23), said hopper drum (1) being equipped with at least one set of signature-seizing grippers (16);

a hopper drum surface element (13) revolving counter to a direction of rotation of said hopper drum to reverse the direction (33) of said signatures when released by said grippers; and a signature seizing element (26) assigned to the reversal position (38) of said signatures, wherein within a hopper drum segment (4) a bearing element (20) for the support of the respective signatures (23) is mounted, and wherein the bearing element (20) is an air bearing.

* * * * *